US009803264B2

(12) United States Patent
Sun et al.

(10) Patent No.: US 9,803,264 B2
(45) Date of Patent: Oct. 31, 2017

(54) HIGH-PLASTICITY FREE-CUTTING ZINC ALLOY

(71) Applicant: Ningbo Powerway Alloy Material Co., Ltd., Ningbo (CN)

(72) Inventors: Wensheng Sun, Ningbo (CN); Shu Yang, Ningbo (CN); Xing Yu, Ningbo (CN); Dingyang Xu, Ningbo (CN); Yongli Chen, Ningbo (CN); Hongbo Zhou, Ningbo (CN); Ming Zhang, Ningbo (CN)

(73) Assignee: Ningbo Powerway Alloy Material Co., Ltd., Ningbo (CN)

( * ) Notice: Subject to any disclaimer, the term of this patent is extended or adjusted under 35 U.S.C. 154(b) by 0 days.

(21) Appl. No.: 14/417,688

(22) PCT Filed: Jan. 26, 2014

(86) PCT No.: PCT/CN2014/000097
§ 371 (c)(1),
(2) Date: Jan. 27, 2015

(87) PCT Pub. No.: WO2015/074317
PCT Pub. Date: May 28, 2015

(65) Prior Publication Data

US 2016/0369375 A1 Dec. 22, 2016

(30) Foreign Application Priority Data

Nov. 25, 2013 (CN) ..... 2013 1 0606071

(51) Int. Cl.
*C22C 18/00* (2006.01)
*C22C 18/02* (2006.01)

(52) U.S. Cl.
CPC ..... *C22C 18/02* (2013.01); *C22C 18/00* (2013.01)

(58) Field of Classification Search
CPC ..... C22C 18/00; C22C 18/02
USPC ..... 420/522
See application file for complete search history.

(56) References Cited

U.S. PATENT DOCUMENTS 2,317,179 A * 4/1943 Daesen ..... C22C 18/00 148/441
2011/0056591 A1* 3/2011 Kondoh ..... B21C 23/002 148/433

FOREIGN PATENT DOCUMENTS

CN 101906555 A * 12/2010
CN 102162047 A * 8/2011 ..... B22D 11/001

OTHER PUBLICATIONS

NPL: English machine translation of CN102162047A, Aug. 2011.*
NPL: English machine translation of CN101906555A, Dec. 2010.*

* cited by examiner

*Primary Examiner* — Jie Yang
(74) *Attorney, Agent, or Firm* — Wang Law Firm, Inc.

(57) ABSTRACT

The present invention relates to a high-plasticity free-cutting zinc alloy, which includes the following components in percentage of weight: 1-10% Cu, 0.1-3.0% Bi, 0.01-1.5% Mn, 0.001-1% Ti and/or 0.01-0.3% Zr, optional component X, optional component Y, and a remainder component being Zn having less than or equal to 0.01% unavoidable impurities, wherein component X amounts to 0-1.0% and includes at least one element selected from Cr, V, Nb, Ni and Co; and component Y amounts to 0-1.0% and includes at least one element selected from B, As, P and rare earth metal. Compared with existing zinc alloys, the present invention has good machinability, higher plasticity and improved processability, which can be widely used in F connectors, pen manufacturing, socket connectors, locks and etc.

1 Claim, 4 Drawing Sheets

| *Element* | *Wt%* | *At%* |
|---|---|---|
| ***TiK*** | 03.08 | 04.14 |
| ***MnK*** | 00.79 | 00.93 |
| ***CuK*** | 06.59 | 06.68 |
| ***ZnK*** | 89.54 | 88.25 |
| ***Matrix*** | Correction | ZAF |

| *Element* | *Wt%* | *At%* |
|---|---|---|
| ***CuK*** | 15.34 | 15.71 |
| ***ZnK*** | 84.66 | 84.29 |
| ***Matrix*** | Correction | ZAF |

| *Element* | *Wt%* | *At%* |
|---|---|---|
| *TiK* | 03.32 | 04.46 |
| *CuK* | 07.97 | 08.08 |
| *ZnK* | 88.72 | 87.46 |
| *Matrix* | Correction | ZAF |

HIGH-PLASTICITY FREE-CUTTING ZINC ALLOY

RELATE APPLICATIONS

This application is a national phase entrance of and claims benefit to PCT Application for High-Plasticity Free-Cutting Zinc Alloy thereof, PCT/CN2014/000097, filed on Jan. 26, 2014, which claims benefit to Chinese Patent Application 201310606071.1, filed on Nov. 25, 2013. The specifications of both applications are incorporated here by this reference.

FIELD OF THE INVENTION

The present invention relates to the field of zinc alloys, in particular to a high-plasticity free-cutting zinc alloy. This alloy is mainly used in F connectors, pen manufacturing, socket connectors, locks and other fields.

DESCRIPTION OF THE PRIOR ART

The machinability of metal is one of important performances of metal material. For example, nonferrous metals used in F connectors, pen manufacturing, socket connectors, locks and other fields are required to have a certain machinability. By cutting machining nonferrous metal bars or sheets by means of instrument lathes, automatic lathes, numerically controlled lathes, etc., desired parts of various sizes and shapes may be obtained. The machinability of alloy significantly influences the cutting machining speed, surface smoothness, dimensional tolerance, etc.

In the modern manufacturing industry, adding a certain number of free-cutting elements into the metal material, which may be manufactured by cutting at a high cutting speed and a large cutting depth, may remarkably improve the productivity of manufactured products and reduce both the labor intensity and the labor cost. Meanwhile, as the addition of the free-cutting elements into the metal material reduces the resistance against cutting of the metal material and the free-cutting material plays a role of lubricating a cutter due to its own characteristics, it is easy to perform chip breaking and relieve the wear. Thus, the roughness of the surface of a workpiece is reduced, and both the service life and the production efficiency of the cutter are improved. However, with the constant development of mechanical cutting towards the characteristics of automation, high speed and preciseness, higher requirements on the machinability of the metal material are proposed, and the material is required to have a certain strength, hardness, plasticity, etc., thus to meet the comprehensive requirements of the existing F connectors, pen manufacturing, socket connectors, locks and other parts on material.

At present, zinc alloys have been researched as an important aspect of a new generation of novel green, environmentally friendly and workable alloys for replacing copper alloys and aluminum alloys, and most attention has been paid to Zn—Al alloys among the zinc alloys. Such alloys have high strength and hardness and good friction reduction performance. However, the Zn—Al alloys have the disadvantages of poor machinability, intercrystalline corrosion tendency, low dimensional stability, poor creep deformation resistance, poor corrosion resistance, etc., and are thus unable to meet the present requirements of those industries mentioned above on workability, high plasticity and other performances of material.

Patent CN10182615B (Patent No. ZL201010147727.4) discloses a Bi-containing unleaded free-cutting deformable zinc alloy and preparation process thereof. This alloy comprises the following components by weight percentage: 8%-12% aluminum (Al), 0.6%-1.5% copper (Cu), 0.03%-0.1% magnesium (Mg), 0.1%-0.8% bismuth (Bi), and the remaining are zinc (Zn) with less than or equal to 0.05% unavoidable impurities. In this specification, it was disclosed only that this alloy has good machinability, but there are no specific data as evidence. Moreover, it has been found from practical applications that, the machinability of this alloy, as one of Zn—Al-based deformable zinc alloys, is still unable to meet the requirements of the modern machining industry.

Patent CN101851713B (Patent No. ZL201010205423.9) discloses a free-cutting and high-strength zinc alloy, comprises the following components in percentage of weight: 1%-25% Al, 0.5%-3.5% Cu, 0.005%-0.3% Mg, 0.01%-0.1% Mn, and 0.005%-0.15% Bi and/or 0.01%-0.1% Sb and less than or equal to 0.05% impurities, and the remaining is Zn, where the total weight percentage of the components is 100%. Optionally, it may be added in B 0.005%-0.2%. Also as one of Zn—Al matrix deformable zinc alloys, this alloy has high strength due to a high content of Al. Although in the specification it was recorded that the tensile strength may be as high as above 400 MPa and the machinability reaches about 80% in comparison to the common lead-containing brass and still does not exceed 90%, there are no records about ductility.

Considering that the existing Zn—Al matrix alloys have poor machinability and are unable to satisfy industries having high requirements on machinability, such as pen shells in the pen manufacturing industry, connector shells in the electronic industry, F connectors, locks and other industries, it is urgent to develop a zinc alloy having good machinability, certain plasticity and strength and excellent comprehensive performance.

SUMMARY OF THE INVENTION

It is an object of the present invention to provide a free-cutting zinc alloy with excellent machinability, high plasticity and improved workability with respect to the existing free-cutting products.

For achieving the above stated object, a high-plasticity free-cutting zinc alloy comprises the following components in percentage of weight: 1-10% Cu, 0.1-3.0% Bi, 0.01-1.5% Mn, 0.001-1% Ti and/or 0.01-0.3% Zr, optional component X, optional component Y, and a remainder component being Zn having less than or equal to 0.01% unavoidable impurities, wherein component X amounts to 0-1.0% and comprises at least one element selected from Cr, V, Nb, Ni and Co; and component Y amounts to 0-1.0% and comprises at least one element selected from B, As, P and rare earth metal.

As a first prefer embodiment, the zinc alloy comprises the following components in percentage of weight: 2-7% Cu, 0.1-1.2% Bi, 0.1-0.4% Mn, 0.01-0.3% Ti, and the remainder component being Zn having less than or equal to 0.01% unavoidable impurities.

As a second prefer embodiment, the zinc alloy comprises the following components in percentage of weight: 2-7% Cu, 0.1-1.2% Bi, 0.1-0.4% Mn and 0.01-0.3% Zr, and the remainder component being Zn having less than or equal to 0.01% unavoidable impurities.

As a third prefer embodiment, the zinc alloy comprises the following components in percentage of weight: 2-7% Cu, 0.1-1.2% Bi, 0.1-0.4% Mn, 0.01-0.3% Ti, 0.01-0.3% Zr, and the remainder component being Zn having less than or equal to 0.01% unavoidable impurities.

Preferably, the zinc alloy further comprises 0.001 to 0.5% rare earth metal.

Preferably, the zinc alloy further comprises 0.01 to 0.3% Cr.

Preferably, the zinc alloy further comprises 0.01 to 0.3% Ni.

The content of components herein is in percentage of weight, unless otherwise stated.

A method for preparing this free-cutting zinc alloy is as follows: adding in Ti, Zr, Cr, V, Nb, Ni and Co in form of intermediate alloys of Zn—Ti, Zn—Zr, Zn—Cr, Zn—V, Zn—Nb, Zn—Ni and Zn—Co during the casting, where the content of these components is 10% of the intermediate alloys; adding Mn in form of an intermediate alloy of Zn—Mn, where the content of Mn is 30%; adding Cu in form of an intermediate alloy of Zn—Cu, where the content of Cu is 60%-70% and the remaining Cu in the alloy is supplemented by pure Cu in terms of content percentage; and, adding Bi and Zn in form of pure metal according to the content of the alloy components. The casting process of the alloy is described as below: this alloy is cast by a line frequency furnace, an intermediate frequency furnace or a reverberatory furnace by means of continuous casting or die casting to obtain a billet; then, the desired bars, tubes or profile billets are obtained by means of hot extrusion, where the temperature for hot extrusion is 180° C.-380° C.; and finally, bars, wires and profile products of various specifications are obtained by cold drawing, where these products are used in fields such as automatic lathes, drill presses, instrument lathes and other manufactured products.

In the new alloy provided by the present invention, the addition of Cu increases the content of a second phase, thereby playing roles of hardening and strengthening. If the addition amount of Cu is less than 1.0%, the effects of hardening and strengthening cannot be achieved; and, if the addition amount of Cu is more than 10%, the plasticity becomes poorer and cold/hot machining becomes difficult. Cu mainly exists in the Zn matrix in form of high-hardness intermetallic compounds.

Bi is distributed in the grain boundary of the zinc alloy in free form, thereby playing a role of chip breaking during high-speed cutting. If the content of Bi is too low, the effect of chip breaking cannot be achieved well; and, if the content of Bi is too high, it is likely to result in embrittlement of material and reduce the plasticity of alloy. Therefore, the content of Bi is to be controlled within a range from 0.1% to 3.0%.

The Ti and Zr in the alloy play a role of refining the grains, enhancing the strength and preventing the segregation.

Cr, Ni, V, Nb and Co exist in the Zn matrix in form of a small amount of second phase intermetallic compounds, thereby achieving the strengthening effect. B, As, P and rare earth metal play a role of purifying the grain boundary and exhausting gas.

The zinc alloy has phases in an as-cast structure comprising, a matrix phase Zn and phases distributed in the matrix phase Zn including a plurality of nearly-spherical Zn—Cu compounds, a plurality of herringbone intermetallic compounds, and free spherical Bi particles, wherein the herringbone intermetallic compounds are mainly Zn—Mn—Cu—Ti compound and/or Zn—Mn—Cu—Zr compound with the remainder being Zn—Cu—Ti compound and/or Zn—Cu—Zr compound. Whether the herringbone intermetallic compounds are one or both of the Zn—Cu—Ti—Mn compound and the Zn—Cu—Zr—Mn compound depends on the addition of one or both of Ti and Zr into the alloy. Zn—Cu—Ti and Zn—Cu—Zr have the similar situation.

The size of the nearly-spherical Zn—Cu compound is above 10 microns.

The free spherical Bi particles are distributed on the grain boundary of the matrix phase Zn and the size thereof is less than 10 microns.

When at least one of Cr, V, Nb, Ni and Co is added into the alloy, these components form compounds with Mn, Zn and Cu and exist on the Zn grain boundary of HCP in a herringbone shape.

The herringbone shape in the present invention refers to a shape like a herringbone, a nonlinear strip shape with non-uniform lateral size and lateral protrusions, specifically referring to the accompanying drawings.

The free spherical Bi particles are distributed on the grain boundary of the matrix phase Zn and the size thereof is less than 10 microns (referring to FIG. 1), thereby achieving the effect of quick chip breaking.

After this alloy of the present invention is plastically manufactured, for example by extrusion, bulky intermetallic compound crystals fracture, and the alloy structure is refined and thus shows higher plasticity (referring to FIG. 2).

As described above, in addition to Bi distributed in free form, the free-cutting zinc alloy provided by the present invention further has high-hardness fine Zn—Cu—Ti—(Mn) or other intermetallic compound as-cast structures. The determination by energy spectrum analysis refers to FIGS. 3, 4, 5, 6, 7 and 8. The inventor(s) has found from studies that the presence of these intermetallic compounds may improve not only the strength and plasticity of the alloy but also the machinability of the alloy and may make the alloy show better machinability than the addition of bismuth only. Particularly in the case of the presence of a proper amount of intermetallic compounds formed of Ti and/or Zr with Zn, Cu and Mn, the machinability is remarkably improved. Further, Ti provides for better effects than Zr. The results of test on the machinability of the alloy show that these intermetallic compounds have certain cooperation with Bi in improving the machinability of the alloy. In conclusion, the presence of these intermetallic compounds may provide the alloy with quite excellent comprehensive performances, with good overall mechanical performance and high cutting efficiency. The tests show that, compared with C3604, the alloy may have machinability of above 80%, plasticity of above 15%, tensile strength of 330-485 MPa, and hardness of HV85-120.

Compared with the prior art, in the present invention, (1) the cutting efficiency may reach above 80% of that of lead-containing brass, dry machining, turning and other machining processes may be achieved without cooling or lubricating conditions, and the alloy is suitable for manufacturing by instrument lathes, automatic lathes and numerically controlled lathes.

(2) in addition to excellent machinability, the alloy also has high ductility which may reach above 15%.

(3) The alloy may be used, as a substitute of some lead-containing brass alloy bars, mainly used in F connectors, pen manufacturing, socket connectors, locks and other manufactured workpieces.

DETAILED DESCRIPTION OF THE PREFERRED EMBODIMENT

Figure 1:
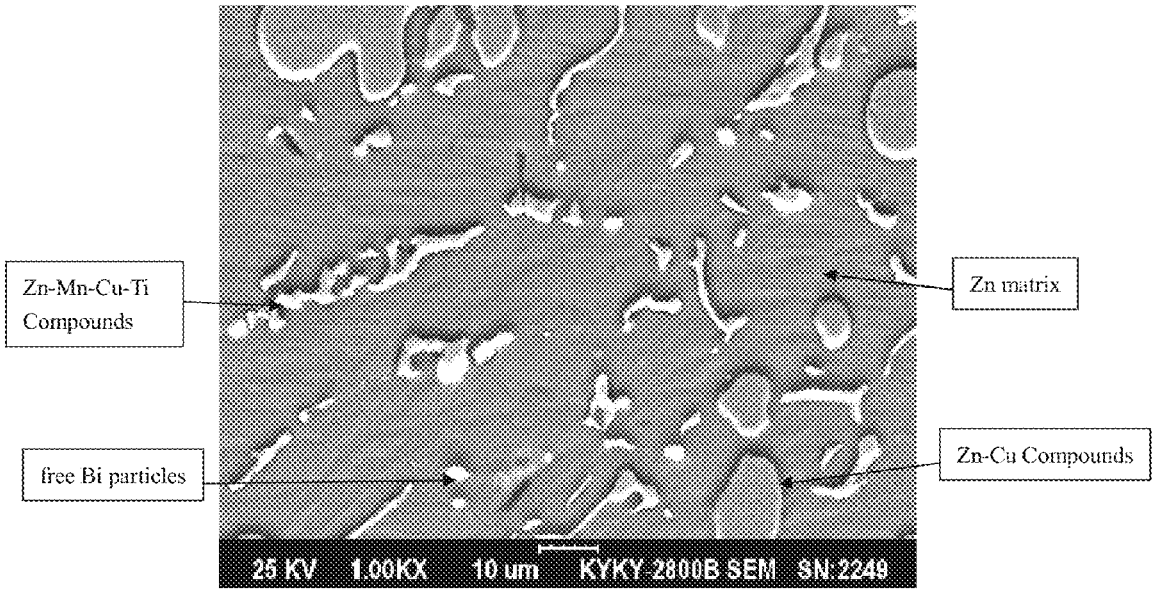
FIG. 1 is a typical as-cast structure of a high-plasticity free-cutting zinc alloy, comprising a matrix phase (Zn), a plurality of nearly-spherical Zn—Cu compounds, a plurality of herringbone intermetallic compounds, and free spherical Bi particles.
Figure 2:
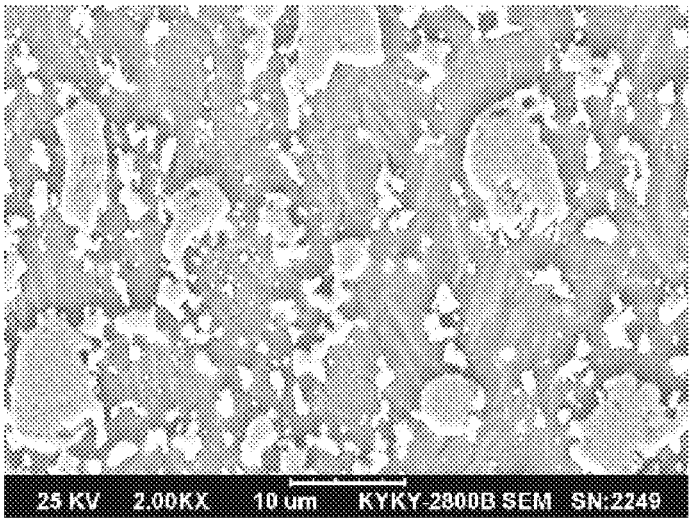
FIG. 2 is a structure crushed after plastic machining.
Figure 3:
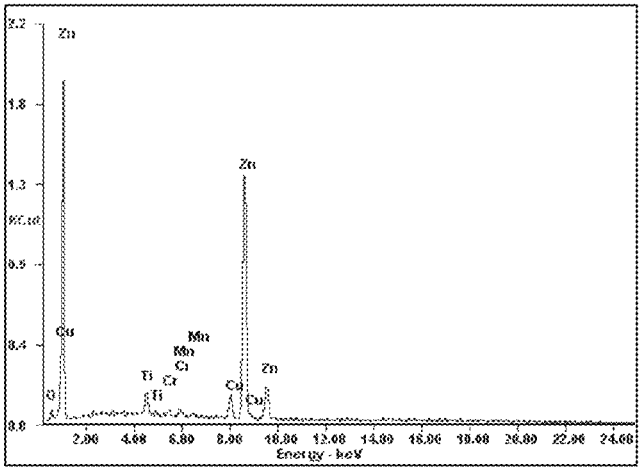
FIG. 3 is an energy spectrum of a Zn—Cu—Mn—Ti quaternary intermetallic compound.
Figure 4:
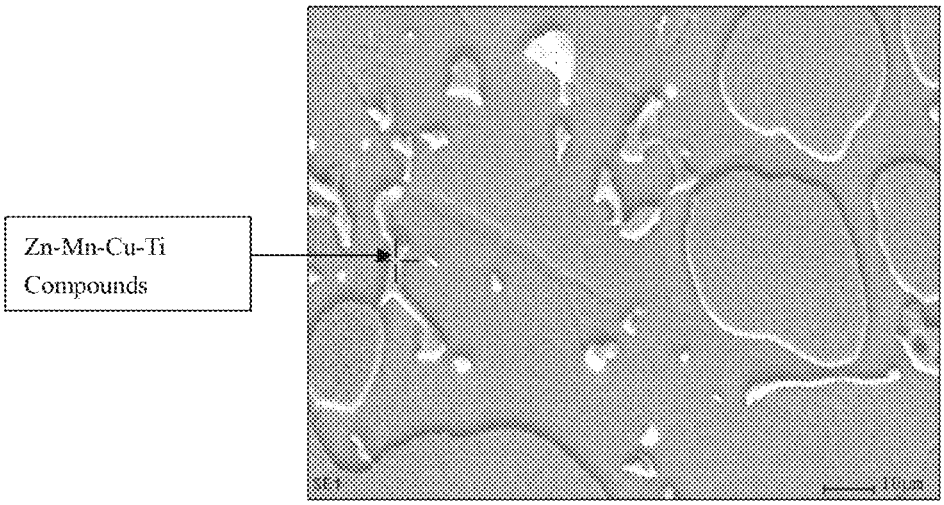
FIG. 4 is the shape of a Zn—Cu—Mn—Ti quaternary intermetallic compound.
Figure 5:
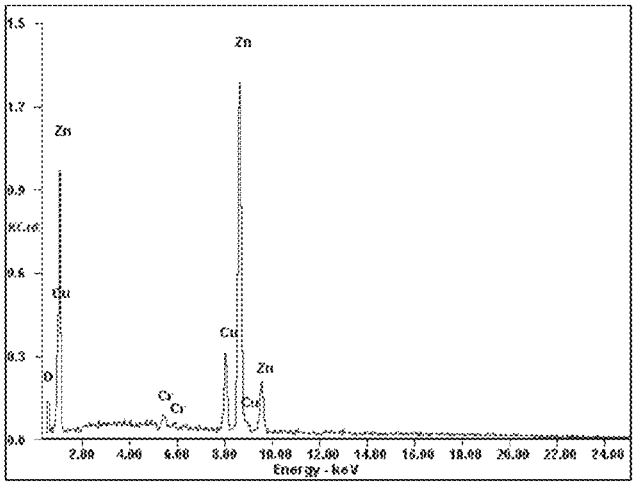
FIG. 5 is an energy spectrum of a Zn—Cu binary alloy.
Figure 6:
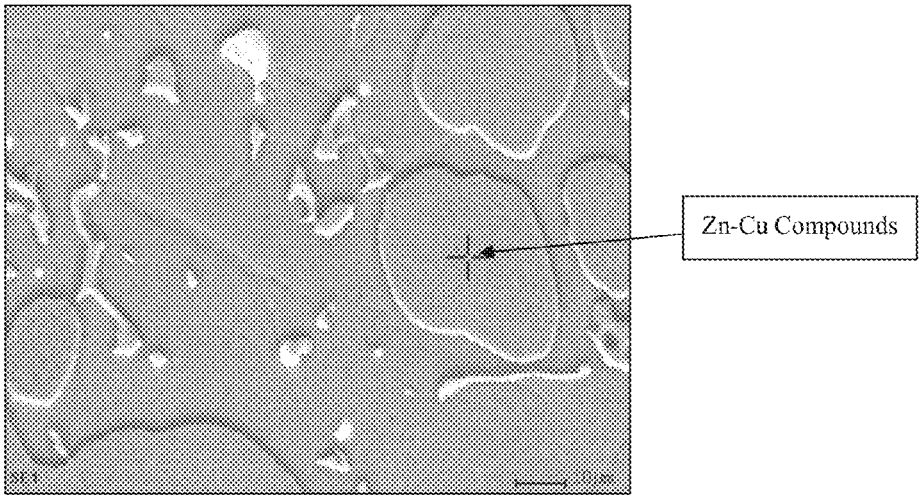
FIG. 6 is the shape of a Zn—Cu binary alloy.
Figure 7:
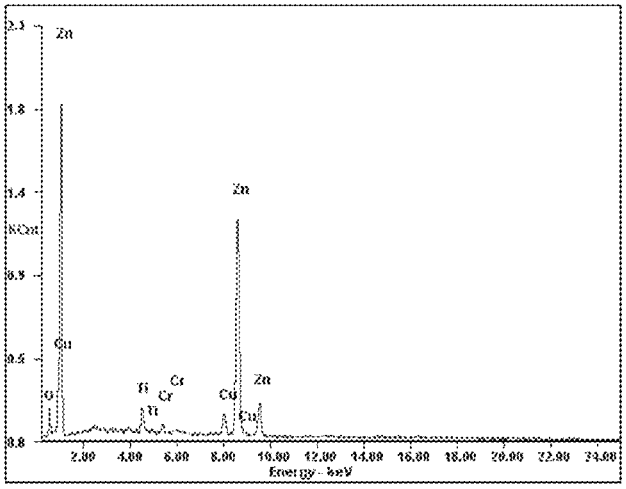
FIG. 7 is an energy spectrum of a Zn—Cu—Ti ternary alloy.
Figure 8:
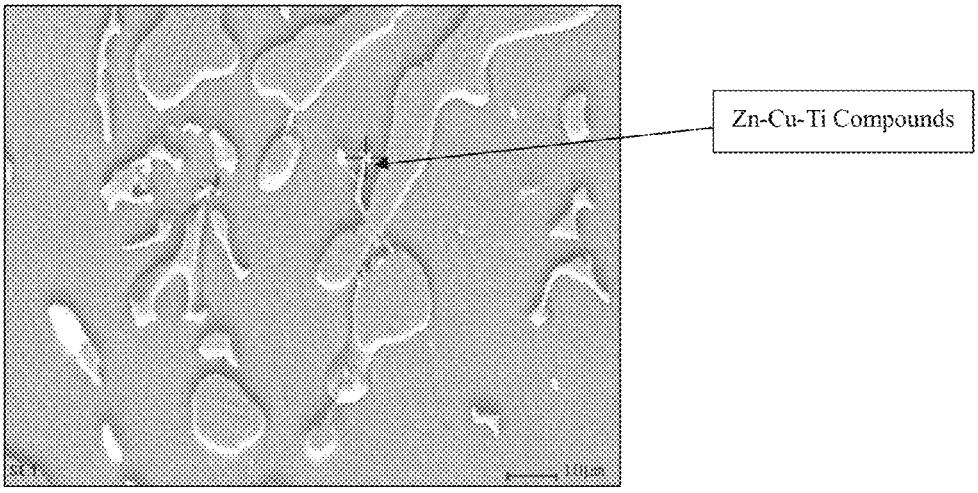
FIG. 8 is the shape of a Zn—Cu—Ti ternary alloy.

To enable a further understanding of the innovative and technological content of the invention herein, refer to the detailed description of the invention and the accompanying drawings below:

This alloy is cast by a line frequency furnace, an intermediate frequency furnace or a reverberatory furnace by means of continuous casting or die casting to obtain a billet; then, the desired bars, tubes or profile billets are obtained by means of hot extrusion, where the temperature for hot extrusion is 180° C.-380° C.; and finally, bars, wires and profile products of various specifications are obtained by cold drawing. The performance test datas of the embodiments refer to Table 1. The alloys of comparing examples CN10182615B (Patent No. ZL201010147727.4) and CN101851713B (Patent No. ZL201010205423.9) are cast according to the methods disclosed in the respective patents. The alloys of two above stated comparing examples and the alloy of the comparing example C3604 are manufactured according to the same method as in this embodiment and respectively tested in terms of the related performance data.

Embodiments 1, 2, 3 and 4

Production process: a master alloy billet with a diameter of 170 mm is obtained by semi-continuous casting and manufactured by hot extrusion to a bar billet at 380° C., and the bar billet is manufactured by joint drawing to a bar of a desired diameter.

The finished bar product is manufactured into a part by drilling it by a cam-type automatic lathe. The cuttings are fragile and the machining efficiency may reach 90% of that of C3604 lead-containing brass (the machining efficiency refers to the ratio of the number of parts of a same shape and size cut by a same cutter under same cutting parameters. For example, assuming that, for C3604 copper alloy, 100 parts are manufactured within 1 min, and for zinc alloy, 90 parts are manufactured within 1 min, the machining efficiency is 90%; similarly hereinafter). The surfaces of the parts may be manufactured by nickeling, chroming, tinning, etc.

Embodiments 5, 6, 7, 8, 9 and 10

Production process: the alloy is smelted by induction heating and manufactured by die casting to obtain an alloy ingot; the alloy ingot is manufactured into a bar billet by extrusion at 240° C.; the bar billet is manufactured to a zinc alloy bar by a crawler-type broaching machine; and, after polished and straightened, the zinc alloy bar is manufactured into an electronic product in a numerically controlled lathe. For parts of a same specification, the machining efficiency by using the numerically controlled lathe may reach 85% of that of C3604 lead-containing brass bars. The surfaces of the parts may be manufactured by nickeling, chroming, tinning, etc.

Embodiments 11, 12 and 13

Production process: the alloy is smelted by induction heating and manufactured by die casting to obtain a master alloy ingot; the alloy ingot is manufactured into an alloy bar billet by extrusion at 180° C.; the alloy bar billet is manufactured into a size of a finished product by multi-die drawing machine; and then, the alloy bar billet is diameter-reduced, straightened and polished to obtain a finished product by joint drawing. By dry machining using a cam type automatic lathe, the machining efficiency may reach 80% of that of the C3604 lead-containing brass of the same specification.

Embodiments 14, 15, 16 and 17

Production process: a master alloy ingot billet is obtained by continuous casting and then manufactured into a profile of 42 mm*15 mm by extrusion at 240° C.

After discharged, the profile is manufactured by a special drill press, with a depth of pores Φ3 mm in diameter being 20 mm. More than 20 pores may be continuously drilled without cooling to obtain a finished padlock body part. The machining efficiency may reach 90% of that of C3604 lead-containing brass bars.

The surfaces of the body part may be manufactured by nickeling, chroming, tinning, etc.

Embodiments 18, 19 and 20

Production process: a master alloy ingot billet is obtained by continuous casting and then manufactured by extrusion at 300° C.

The master alloy ingot billet is manufactured into a bar of a desired diameter by joint drawing. After discharged, the bar is manufactured by a special drill press, with a depth of pores Φ9.8 mm in diameter being 20 mm. More than 20 pores may be continuously drilled to obtain a finished metal pen part. The machining efficiency may reach 85% of that of C3604 lead-containing brass bars.

Embodiments 21, 22 and 23

Production process: a master alloy ingot billet is obtained by continuous casting and then manufactured into a bar billet of a proper specification by extrusion at 320° C.

The bar billet is manufactured into a bar of a desired diameter by joint drawing.

After discharged, the bar is manufactured by a special drill press, with a depth of pores Φ3 mm in diameter being 35 mm. More than 20 pores may be continuously drilled to obtain a finished metal pen part. The machining efficiency may reach 85% of that of C3604 lead-containing brass bars.

Embodiments 24, 25, 26 and 27

Production process: a master alloy ingot billet is obtained by continuous casting and then manufactured into a bar Φ25 mm in diameter by extrusion at 320° C.; and the bar is manufactured into a bar in a desired diameter by joint drawing.

After discharged, the bar is manufactured by a special drill press, with a depth of pores Φ2.8 mm in diameter being 25 mm. More than 20 pores may be continuously drilled. The machining efficiency may reach 85% of that of C3604 lead-containing brass bars.

Embodiments 28, 29 and 30

Production process: a master alloy ingot billet is obtained by continuous casting and then manufactured into a bar Φ12 mm in diameter by extrusion at 340° C.; and the bar is manufactured into a bar in a desired diameter by joint drawing.

After discharged, the bar is manufactured by a cam lathe. More than 200 parts may be continuously produced without cooling to obtain a finished metal pen part. The machining efficiency may reach 90% of that of C3604 lead-containing brass bars.

Embodiments 31 and 32

Production process: a master alloy ingot billet is obtained by continuous casting and then manufactured into a wire 10 mm in diameter by peeling, diameter reducing and stretching.

After discharged, the wire is manufactured by a special drill press, with a depth of pores Φ5 mm in diameter being 30 mm. More than 20 pores may be continuously drilled to obtain a finished part. The machining efficiency may reach 80% of that of C3604 lead-containing brass bars.

TABLE 1

Comparison between embodiments of alloy of the present invention and comparing alloys in terms of components and performance

| Alloys of the invention and comparing examples | Alloy components (wt %) | | | | | | | | | |
|---|---|---|---|---|---|---|---|---|---|---|
| | Cu | Bi | Mn | Ti | Zr | Cr | V | Nb | Ni | B |
| 1 | 2.53 | 0.28 | 0.89 | 0.34 | | | | | 0.27 | |
| 2 | 3.12 | 2.10 | 1.22 | 0.19 | 0.16 | | | | | |
| 3 | 4.15 | 0.38 | 0.19 | | | | | | | |
| 4 | 7.54 | 0.16 | 0.08 | 0.01 | | | | | | |
| 5 | 6.07 | 0.15 | 0.21 | 0.098 | | 0.14 | | | | |
| 6 | 5.89 | 0.35 | 0.11 | 0.11 | | | | | 0.18 | |
| 7 | 1.51 | 2.04 | 0.25 | 0.89 | | | | | | |
| 8 | 5.03 | 0.51 | 0.45 | 0.18 | 0.12 | | | | | |
| 9 | 4.51 | 0.75 | 0.53 | 0.33 | | | | | 0.23 | |
| 10 | 3.53 | 1.25 | 1.32 | | | | | | | |
| 11 | 9.23 | 0.82 | 0.05 | 0.02 | | 0.15 | | | | |
| 12 | 4.02 | 0.85 | 1.02 | 0.16 | 0.21 | | | | | |
| 13 | 3.02 | 2.54 | 0.65 | 0.26 | | | | | | |
| 14 | 2.51 | 1.75 | 0.39 | 0.71 | 0.02 | | | | | |
| 15 | 4.45 | 0.88 | 0.67 | | | | 0.001 | | | 0.02 |
| 16 | 1.02 | 2.98 | 0.15 | 0.25 | | | | | | |
| 17 | 3.01 | 0.43 | 0.36 | 0.12 | | | | 0.03 | | |
| 18 | 4.27 | 0.91 | 0.80 | 0.28 | | | | | | |
| 19 | 3.21 | 0.77 | 1.42 | | 0.25 | | | | | |
| 20 | 5.21 | 0.25 | 0.28 | 0.017 | | | | | | |
| 21 | 4.59 | 0.59 | 0.19 | 0.31 | 0.06 | | | Co 0.03 | | |
| 22 | 5.59 | 2.31 | 0.32 | 0.43 | 0.05 | | | | | |
| 23 | 2.58 | 0.32 | 1.23 | 0.22 | | | | | | |
| 24 | 3.51 | 0.65 | 0.98 | 0.60 | | | | | | |
| 25 | 6.59 | 1.89 | 1.36 | 0.54 | | 0.23 | | | | |
| 26 | 3.14 | 1.45 | 1.49 | 0.74 | | | | | | |
| 27 | 8.12 | 0.18 | 0.13 | 0.009 | 0.29 | 0.01 | 0.01 | | | 0.005 |
| 28 | 5.55 | 0.49 | 0.42 | 0.21 | | | | | | |
| 29 | 2.01 | 0.20 | 0.15 | 0.82 | | | | | | |
| 30 | 4.36 | 0.11 | 0.59 | | 0.09 | | | | | |
| 31 | 6.51 | 0.35 | 0.15 | | 0.19 | | | | | |
| 32 | 9.98 | 0.12 | 0.01 | 0.002 | | | | | 0.01 | |
| ZL201010147727.4 | 1.2 | 0.5 | Mg: 0.06 | Al: 7.2 | | | | | | |
| ZL201010205423.9 | 2.1 | 0.08 | 0.08 | Al: 0.2 | | Mg: 0.18 | Sb: 0.06 | | | |
| C3604 | 61.5 | | Pb: 3.01 | | | | | | | |

| Alloys of the invention and comparing examples | Alloy components (wt %) | | | | Performance | | | |
|---|---|---|---|---|---|---|---|---|
| | P | As | RE | Zn | Tensile strength/ MPa | Plasticity/ % | Hardness/ Hv | Machinability/% (compared with C3604) |
| 1 | | | | The remaining | 360 | 23 | 95 | 85 |
| 2 | | | | The remaining | 360 | 23 | 95 | 85 |
| 3 | 0.02 | | | The remaining | 330 | 20 | 90 | 85 |
| 4 | | | | The remaining | 485 | 16 | 120 | 90 |
| 5 | | | | The remaining | 385 | 19 | 95 | 85 |
| 6 | | | | The remaining | 365 | 25 | 93 | 85 |

TABLE 1-continued

| Comparison between embodiments of alloy of the present invention and comparing alloys in terms of components and performance | | | | | | | | |
|---|---|---|---|---|---|---|---|---|
| 7 | | | 0.03 | The remaining | 405 | 22 | 100 | 90 |
| 8 | | | | The remaining | 485 | 25 | 120 | 85 |
| 9 | | | | The remaining | 485 | 25 | 120 | 85 |
| 10 | | | | The remaining | 430 | 24 | 112 | 80 |
| 11 | | | | The remaining | 485 | 16 | 120 | 90 |
| 12 | | | | The remaining | 440 | 23 | 105 | 80 |
| 13 | | | | The remaining | 405 | 22 | 95 | 90 |
| 14 | | | 0.01 | The remaining | 405 | 22 | 95 | 90 |
| 15 | | | | The remaining | 445 | 25 | 115 | 85 |
| 16 | | | | The remaining | 365 | 22 | 95 | 90 |
| 17 | 0.04 | | | The remaining | 430 | 20 | 100 | 85 |
| 18 | | | | The remaining | 465 | 24 | 105 | 80 |
| 19 | | | | The remaining | 450 | 20 | 105 | 85 |
| 20 | | | | The remaining | 355 | 19 | 90 | 85 |
| 21 | | | 0.05 | The remaining | 385 | 19 | 90 | 85 |
| 22 | | 0.02 | | The remaining | 445 | 17 | 110 | 90 |
| 23 | | | | The remaining | 445 | 17 | 110 | 90 |
| 24 | 0.12 | | | The remaining | 445 | 17 | 110 | 90 |
| 25 | | | | The remaining | 445 | 17 | 110 | 90 |
| 26 | | | 0.04 | The remaining | 460 | 23 | 115 | 85 |
| 27 | 0.04 | | 0.004 | The remaining | 385 | 16 | 90 | 90 |
| 28 | | | | The remaining | 385 | 25 | 93 | 85 |
| 29 | | | 0.003 | The remaining | 370 | 25 | 90 | 80 |
| 30 | | | | The remaining | 420 | 25 | 90 | 80 |
| 31 | | | | The remaining | 385 | 25 | 93 | 85 |
| 32 | | | | The remaining | 485 | 16 | 120 | 90 |
| ZL201010147727.4 | | | | The remaining | 360 | 10 | 72 | 63 |
| ZL201010205423.9 | | | | The remaining | 402 | 5 | 130 | 81 |
| C3604 | | | | The remaining | | | | 98 |

The invention claimed is:

1. A free-cutting zinc alloy comprising the following components in percentage of weight:

2-7% Cu, 0.1-1.2% Bi, 0.1-0.4% Mn, 0.01-0.3% Ti, and 0.01-0.02% Zr, optional component X, optional component Y, and a remainder component being Zn having less than or equal to 0.01% unavoidable impurities, wherein component X amounts to 0-1.0% and comprises at least one element selected from Cr, V, Nb, Ni and Co; and component Y amounts to 0-1.0% and comprises at least one element selected from B, As, P and rare earth metal, wherein the zinc alloy has phases in an as-cast structure, and further comprises a matrix phase Zn and phases distributed in the matrix phase Zn including a plurality of Zn—Cu compounds, a plurality of herringbone intermetallic compounds, and free spherical Bi particles, the herringbone intermetallic compounds are mainly Zn—Mn—Cu—Ti compound and/or Zn—Mn—Cu—Zr compound with the remainder being Zn—Cu—Ti compound and/or Zn—Cu—Zr compound.

* * * * *